US009623694B2

(12) United States Patent
Gao et al.

(10) Patent No.: US 9,623,694 B2
(45) Date of Patent: Apr. 18, 2017

(54) RIBBON CARTRIDGE, THERMAL TRANSFER PRINTER, AND METHOD FOR INSTALLING RIBBON CARTRIDGE

(71) Applicant: Shandong New Beiyang Information Technology Co., Ltd., Shandong (CN)

(72) Inventors: Ming Gao, Shandong (CN); Haiyun Deng, Shandong (CN); Shuxun Dong, Shandong (CN); Xin Wang, Shandong (CN)

(73) Assignee: Shandong New Beiyang Information Technology Co., Ltd., Shandong (CN)

( * ) Notice: Subject to any disclaimer, the term of this patent is extended or adjusted under 35 U.S.C. 154(b) by 0 days.

(21) Appl. No.: 14/784,005

(22) PCT Filed: Apr. 15, 2014

(86) PCT No.: PCT/CN2014/075415
§ 371 (c)(1),
(2) Date: Oct. 12, 2015

(87) PCT Pub. No.: WO2014/169813
PCT Pub. Date: Oct. 23, 2014

(65) Prior Publication Data

US 2016/0067991 A1 Mar. 10, 2016

(30) Foreign Application Priority Data

Apr. 17, 2013 (CN) ..... 2013 1 0134207

(51) Int. Cl.
*B41J 32/00* (2006.01)
*B41J 3/36* (2006.01)
(Continued)

(52) U.S. Cl.
CPC ..... *B41J 32/00* (2013.01); *B41J 2/32* (2013.01); *B41J 2/325* (2013.01); *B41J 3/36* (2013.01); *B41J 17/32* (2013.01)

(58) Field of Classification Search
CPC ..... B41J 17/32; B41J 2/325; B41J 3/36; B41J 35/03; B41J 35/20; B41J 35/28
See application file for complete search history.

(56) References Cited

U.S. PATENT DOCUMENTS 4,496,955 A 1/1985 Maeyama et al.
4,663,637 A 5/1987 Saitou
5,588,756 A * 12/1996 Hamisch, Jr. ..... B41J 3/36 400/208

FOREIGN PATENT DOCUMENTS

CN 1176182 A 3/1998
CN 101077665 A 11/2007
JP 2004009347 A 1/2004

OTHER PUBLICATIONS

International Search Report mailed on Jul. 16, 2014, in the International Application No. PCT/CN2014/075415, filed Apr. 15, 2014, 2 pages.

* cited by examiner

*Primary Examiner* — Juanita D Jackson
(74) *Attorney, Agent, or Firm* — Wilmer Cutler Pickering Hale and Dorr LLP

(57) ABSTRACT

Disclosed are a ribbon cartridge, a thermal transfer printer, and a method for installing the ribbon cartridge. The ribbon cartridge (2) comprises a bracket (23), a supply cylinder (21) arranged on the bracket and used for accommodating an unused ribbon, and a winding cylinder (22) arranged on the bracket and used for accommodating a used ribbon, where the supply cylinder and the winding cylinder are placed in parallel, and have an initial state in which the supply
(Continued)

cylinder and the winding cylinder are close to each other and an open state in which the supply cylinder and the winding cylinder are away from each other under the action of an external force. Compared with a ribbon cartridge whose supply cylinder and winding cylinder are arranged at a fixed interval in the prior art, the ribbon cartridge as disclosed is more compact and needs less installation space.

11 Claims, 6 Drawing Sheets

(51) Int. Cl.

| | |
|---|---|
| ***B41J 2/325*** | (2006.01) |
| ***B41J 17/32*** | (2006.01) |
| ***B41J 2/32*** | (2006.01) |

--Prior art--

RIBBON CARTRIDGE, THERMAL TRANSFER PRINTER, AND METHOD FOR INSTALLING RIBBON CARTRIDGE

CROSS-REFERENCE TO RELATED APPLICATIONS

This application is a National Stage Entry of PCT International Application No. PCT/CN2014/075415 filed on Apr. 15, 2014, which claims priority to Chinese patent application No. 201310134207.3, entitled "Ribbon Cartridge, Thermal Transfer Printer and Method For Installing Ribbon Cartridge" and filed on Apr. 17, 2013 with the State Intellectual Property Office of China, the disclosure of which is incorporated therein by reference in its entirety.

TECHNICAL FIELD

The present disclosure relates to a ribbon cartridge, a thermal transfer printer using the ribbon cartridge, and a method for installing the ribbon cartridge.

BACKGROUND

As shown in FIG. 1, a ribbon cartridge 1' adopted in an existing thermal transfer printer includes a supply cylinder 31', a winding cylinder 32', and a printing head accommodating member 33' located between the supply cylinder 31' and the winding cylinder 32', which are rigidly connected. A supply spool (not shown) configured to support an unused ribbon is disposed within the supply cylinder 31', a winding spool (not shown) configured to support and wind the used ribbon is disposed within the winding cylinder 32', and both the supply spool and the winding spool are freely rotatable about their own axes. A driving hole (not shown) is provided at an end of the winding cylinder 32' and is configured to match with a driving shaft 102' in a plugging manner on a frame 101' of the printer 100'. Thus, a ribbon 10' may lead out from an opening of the supply cylinder 31', extend through the printing head accommodating member 33', enter into the winding cylinder 32' via an opening 35' thereof and be wound on the winding spool.

The frame 101' includes a cartridge installing member 130', which has a cross-section of a shape matching with the shape of the cross-section of the ribbon cartridge 1'. A locking assembly 137' is disposed on a side wall of the frame 101' and is configured to prevent release of the ribbon cartridge 1' installed in the printer 100'. The locking assembly 137' includes a body 137*a*, an elastic slice 137*b* and an operating slice 137*c* which are formed integrally with the body 137*a*, and a locking hook 137*d*. To install the ribbon cartridge 1', the ribbon cartridge 1' is inserted into the cartridge installing member 130' via an installing hole 133' on a side of the printer 100', the driving hole of the ribbon cartridge 1' matches with the driving shaft 102' on the printer 100' in a plugging manner, and the locking hook 137*d* of the locking assembly 137' locks a side wall 26' of the ribbon cartridge 1'; subsequently, a printing head assembly 110' is rotated and closed with respect to the frame 101' so that a printing head of the printing head assembly 110' is tangent to and cooperates with a platen 120', in this way, the printing head is located within the printing head accommodating member 33' and in contact with the ribbon 10'.

The above-described thermal transfer printer 100' and the ribbon cartridge 1' used therein are defective in that: the supply cylinder 31' and the winding cylinder 32' of the ribbon cartridge 1' are linearly connected rigidly, and the printing head is located within the printing head accommodating member 33' between the supply cylinder 31' and the winding cylinder 32' when the ribbon cartridge 1' is installed in the printer, that is, the supply cylinder 31' of the ribbon cartridge 1', the printing head, and the winding cylinder 32' of the ribbon cartridge 1' are linearly arranged in sequence, thereby increasing the distance between front and rear sides of the printer, so that the space on a top surface of a desk occupied by the printer is increased, and a demand for the miniaturization of the printer cannot be met.

SUMMARY OF THE INVENTION

An object of the present disclosure is to provide a ribbon cartridge with a compact structure, and further provide a thermal transfer printer adopting the ribbon cartridge and a method for installing the ribbon cartridge.

To this end, according to one aspect of the present disclosure, a ribbon cartridge includes a bracket; a supply cylinder disposed on the bracket and configured for accommodating an unused ribbon; and a winding cylinder disposed on the bracket and configured for accommodating a used ribbon, where the supply cylinder and the winding cylinder are arranged in parallel, and the supply cylinder and the winding cylinder have an initial state in which the supply cylinder and the winding cylinder are close to each other and an open state in which the supply cylinder and the winding cylinder are away from each other due to an effect of an external force.

The bracket is located at the same side of the supply cylinder and the winding cylinder, and a ribbon exposing opening is provided in the bracket.

The bracket is configured to apply an elastic force to the supply cylinder and the winding cylinder, so that the supply cylinder and the winding cylinder always trend to return to the initial state.

The bracket includes a first cantilever part and a second cantilever part which is fixedly connected or integrally formed with the first cantilever part, a suspending end of the first cantilever part is connected with the winding cylinder, a suspending end of the second cantilever part is connected with the supply cylinder, and the first cantilever part and/or the second cantilever part is elastic.

The bracket includes a first cantilever part, a second cantilever part which is pivoted with the first cantilever part, and an elastic element disposed between the first cantilever part and the second cantilever part, where a suspending end of the first cantilever part is connected with the winding cylinder, and a suspending end of the second cantilever part is connected with the supply cylinder.

Each of the supply cylinder and the winding cylinder includes a cylinder body for accommodating a ribbon, an opening for ribbon formed on the cylinder body, and a support shaft disposed on an end wall of the cylinder body along an axial direction of the cylinder body and configured for supporting a ribbon core cylinder, where a transmission gear in a transmission connection with an external power is arranged on the support shaft provided on the supply cylinder and/or the support shaft provided on the winding cylinder.

A cylinder body of the supply cylinder includes a first part formed integrally with the bracket and a first half-cylinder body jointed with the first part, a space for accommodating an unused ribbon is formed between the first part and the first half-cylinder body, a cylinder body of the winding cylinder includes a second part formed integrally with the bracket and a second half-cylinder body jointed with the second part, and a space for accommodating a used ribbon is formed between the second part and the second half-cylinder body.

A pull handle is disposed on the bracket.

According to another aspect of the present disclosure, a thermal transfer printer includes: a frame; and a printing head assembly, a platen and a paper roll support mechanism which are disposed on the frame, where the thermal transfer printer further includes the above ribbon cartridge installed in the frame, a winding cylinder and a supply cylinder of the ribbon cartridge are moved away from each other to avoid the printing head assembly during installing of the ribbon cartridge, and the winding cylinder and the supply cylinder of the ribbon cartridge installed in place are close to each other at a same side of the printing head assembly.

The thermal transfer printer further includes a first positioning portion disposed on the frame and configured for positioning the winding cylinder and a second positioning portion disposed on the frame and configured for positioning the supply cylinder, and a driving member is disposed on the first positioning portion and configured to drive a support shaft on the winding cylinder to rotate and wind a ribbon.

The frame includes a body and a guide structure disposed on the body and configured to guide the winding cylinder and the supply cylinder of the ribbon cartridge during the installing of the ribbon cartridge, the body includes side walls and a connection part perpendicularly connected with the side walls, and the printing head assembly is configured to be installed on the connection part, where the guide structure includes an upper guide portion and a lower guide portion which are located at upper and lower sides of the printing head assembly, one of the upper guide portion and the lower guide portion is formed by guide ribs arranged on the side walls, and the other of the upper guide portion and the lower guide portion is formed by the connection part.

The first positioning portion is formed by a first arc-shaped rib transitively connected with the connection part, the second positioning portion is formed by a second arc-shaped rib transitively connected with the guide rib, and each of the first arc-shaped rib and the second arc-shaped rib protrudes from an inner surface of the side wall and has an unenclosed structure with an opening.

According to the present disclosure, a method for installing the above ribbon cartridge includes: pushing a ribbon cartridge toward a printing head assembly from an outer side of the printing head assembly, so that a supply cylinder and a winding cylinder of the ribbon cartridge run across the printing head assembly and installed in place.

According to the present disclosure, the supply cylinder and the winding cylinder of the ribbon cartridge are connected via a bracket. In installing the ribbon cartridge, the supply cylinder and the winding cylinder are moved away from each other due to the pressure by the printing head assembly and avoid the printing head assembly, so that the ribbon is tensioned by the printing head and covers the printing head, and after avoiding the printing head assembly, the supply cylinder and the winding cylinder return to the initial state in which they are close to each other. Therefore, compared with the existing ribbon cartridge including a supply cylinder and a winding cylinder which are fixedly spaced, the ribbon cartridge of the present disclosure has a more compact structure and requires for a reduced installing space.

In addition to the above objects, features and advantages, other objects, features and advantages of the present disclosure will be further described in detail in combination with the accompanying drawings.

BRIEF DESCRIPTION OF THE DRAWINGS

Accompanying drawings, which construct a part of the specification and are used for better understanding of the present disclosure, illustrate some preferred embodiments of the present disclosure, and show principles of the present disclosure in combination with the description below.

LIST OF REFERENCE NUMERALS

| | |
|---|---|
| 1. Printing mechanism | 2. Ribbon cartridge |
| 3. Paper roll support mechanism | 11. Printing head assembly |
| 12. Platen | 111. Support plate |
| 112. Printing head | 113. Elastic element |
| 111a. Bent portion | 121. Platen gear |
| 21. Supply cylinder | 22. Winding cylinder |
| 23. Bracket | 24. Support shaft |
| 25. Transmission gear | 26. Pull handle |
| 21a. First part | 21b. First half-cylinder body |
| 22a. Second part | 22b. Second half-cylinder body |
| 211. First opening for ribbon | 221. Second opening for ribbon |
| 231. First cantilever part | 232. Second cantilever part |
| 232a. Ribbon exposing opening | 241. Rotation stop part |
| 80. Body | 81. Upper cover |
| 82. Front cover | 83. Left wall |
| 84. Right wall | 85. Connection part |
| 811. First pivot shaft | 821. Second pivot shaft |
| 851. Front portion | 6. Positioning part |
| 61. First positioning portion | 62. Second positioning portion |
| 63. Guide rib | 61a. First arc-shaped rib |
| 62a. Second arc-shaped rib | 611. Opening |
| 621. Opening | 9. Driving member |

DETAILED DESCRIPTION OF THE EMBODIMENTS

Embodiments of the present disclosure are described in detail below in combination with the accompanying drawings, although the present disclosure can be implemented in various ways defined and covered by the appended claims.

Figure 1:
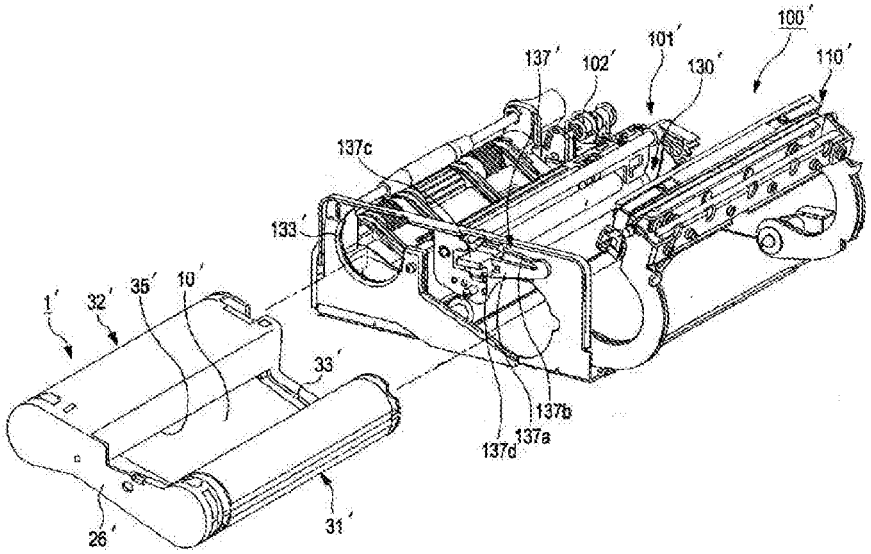
FIG. 1 is a schematic structural view of an existing thermal transfer printer.
Figure 2:
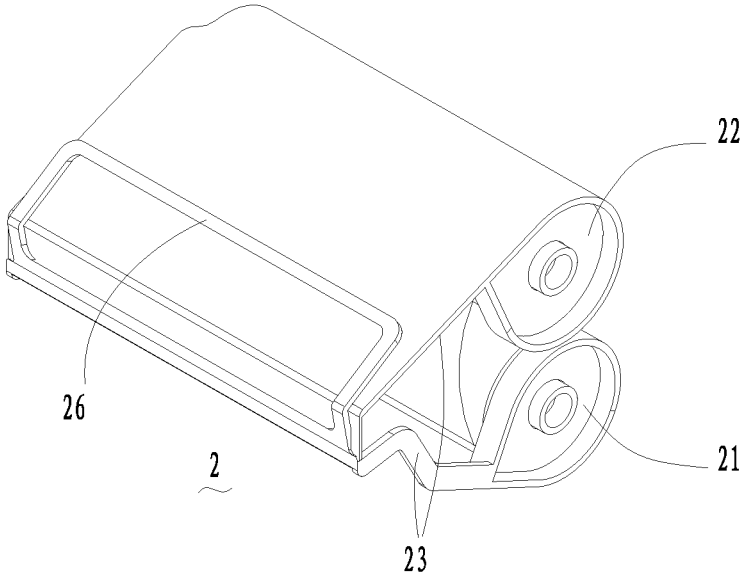
FIG. 2 is an isometric structural view of a ribbon cartridge according to an embodiment of the present disclosure.
Figure 3:
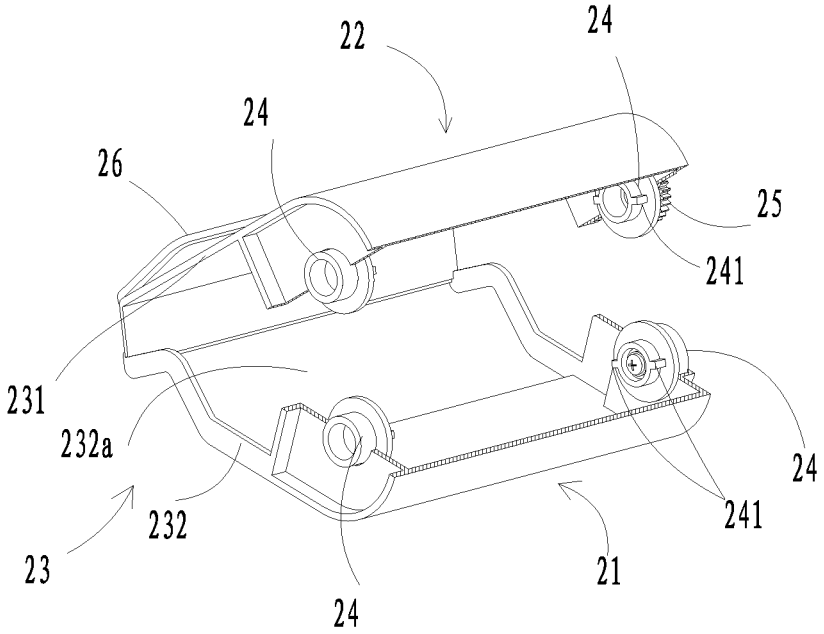
FIG. 3 is a partial structural section view of the ribbon cartridge according to the embodiment of the present disclosure.
Figure 4:
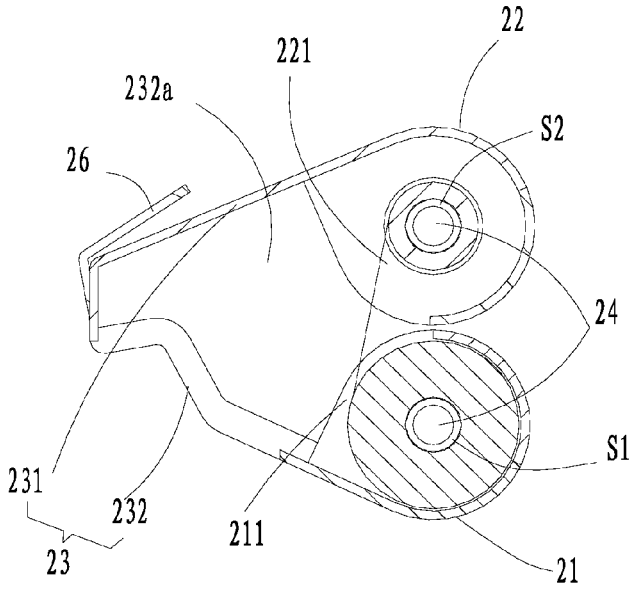
FIG. 4 is a cross-section view of the ribbon cartridge according to the embodiment of the present disclosure.

FIG. 2 is an isometric structural view of a ribbon cartridge according to an embodiment of the present disclosure, FIG. 3 is a partial structural section view of the ribbon cartridge according to the embodiment of the present disclosure, and FIG. 4 is a cross-section view of the ribbon cartridge according to the embodiment of the present disclosure. As shown in FIG. 2, FIG. 3 and FIG. 4, a ribbon cartridge 2 includes a supply cylinder 21, a winding cylinder 22 and a bracket 23. The supply cylinder 21 and the winding cylinder 22, each having a columnar shape and having a length larger than the maximum width of the ribbon, are disposed one above another, and axes of the supply cylinder 21 and the winding cylinder 22 are parallel to each other. The diameter of the winding cylinder 22 is larger than or equal to the diameter of the supply cylinder 21. Here, the supply cylinder 21 is configured to accommodate an unused ribbon, while the winding cylinder 22 is configured to accommodate a used ribbon. The ribbon leads out from the supply cylinder 21 and is eventually recycled in the winding cylinder 22.

The bracket 23 is located at the same side of the supply cylinder 21 and the winding cylinder 22, and a ribbon exposing opening 232*a* is provided in the bracket 23. Preferably, the bracket 23 includes a first cantilever part 231 and a second cantilever part 232, a first end of the first cantilever part 231 is connected with a first end of the second cantilever part 232, a second end (i.e. a suspending end) of the first cantilever part 231 is fixed to the winding cylinder 22, and a second end (i.e. a suspending end) of the second cantilever part 232 is connected with the supply cylinder 21. The ribbon exposing opening 232*a* is arranged in the second cantilever part 232, and has a shape and a size respectively matching with the shape and size of the printing head. A cavity is formed between the first cantilever part 231 and the second cantilever part 232 to accommodate a printing head assembly.

The bracket 23 is configured to apply an elastic force to the supply cylinder 21 and the winding cylinder 22, so that the supply cylinder 21 and the winding cylinder 22 always trend to return to their initial states in which the supply cylinder 21 and the winding cylinder 22 are close to each other. Preferably, the bracket 23 is partially or entirely elastic. In the present embodiment, the first cantilever part 231 and the second cantilever part 232 of the bracket 23 are fixedly connected, and the first cantilever part 231 and/or the second cantilever part 232 are made of an elastic material such as plastic or spring steel, so that the supply cylinder 21 and the winding cylinder 22 always trend to move to be close to each other under the effect of the elastic force applied by the first cantilever part 231 and/or the second cantilever part 232 of the bracket 23. In some other embodiments of the present disclosure, the first cantilever part 231 is pivoted with the second cantilever part 232 via a pivot shaft, and the bracket 23 further includes an elastic element, one end of which is connected with the first cantilever part 231 and the other end of which is connected with the second cantilever part 232, so that the supply cylinder 21 and the winding cylinder 22 always trend to move to be close to each other under the effect of an elastic force applied by the elastic element. Preferably, when the supply cylinder and the winding cylinder are at their initial status, the external walls of the supply cylinder and the winding cylinder are tangent to and abut on each other, to enable the most compact structure of the ribbon cartridge.

A first opening for ribbon 211 is disposed on the wall of the supply cylinder 21 along an axial direction of the supply cylinder 21, and a second opening for ribbon 221 is disposed on the wall of the winding cylinder 22 along an axial direction of the winding cylinder 22, so that the unused ribbon in the supply cylinder 21 may lead out from the first opening for ribbon 211 and enter into the winding cylinder 22 via the second opening for ribbon 221.

A support shaft 24 for supporting a ribbon core cylinder is provided at each of both axial ends of the supply cylinder 21, a support shaft 24 for supporting a ribbon core cylinder is provided at each of both axial ends of the winding cylinder 22, and a transmission gear 25 is fixed on the support shaft provided at one of both axial ends of the winding cylinder 22. As such, two support shafts 24 are coaxially disposed at both axial ends of the supply cylinder 21 to support a ribbon supply core cylinder S1 on which the unused ribbon is wound, and the other two support shafts 24 are coaxially disposed at both axial ends of the winding cylinder 22 to support a ribbon winding core cylinder S2 on which the used ribbon is wound. Each support shaft 24 has an external diameter matching with an internal diameter of the corresponding core cylinder, and is freely rotatable about its own axis. At least one rotation stop part 241 extending along a radial direction of the support shaft 24 are disposed at the periphery of each of the support shafts 24, and has a width matching with a width of a positioning groove on the corresponding core cylinder. The transmission gear 25 is fixed to one of the two support shafts 24 for supporting the ribbon winding core cylinder S2 and is located at an outer side of the winding cylinder 22.

In the present embodiment, two rotation stop parts 241 are provided on each of the support shafts 24 symmetrically relative to the axis of the support shaft 24.

The ribbon supply core cylinder S1, on which the unused ribbon is wound, is located within the supply cylinder 21, two ends of the ribbon supply core cylinder S1 respectively match with those two support shafts 24 at both ends of the supply cylinder 21 in a plugging manner, and the positioning groove on the ribbon supply core cylinder S1 matches with the rotation stop part 241 on the corresponding support shaft 24 in a plugging manner. The ribbon winding core cylinder S2 is located within the winding cylinder 22, two ends of the ribbon winding core cylinder S2 respectively match with those two support shafts 24 at both ends of the winding cylinder 22 in a plugging manner, and the positioning groove on the ribbon winding core cylinder S2 matches with the rotation stop part 241 on the corresponding support shaft 24 in a plugging manner.

The unused ribbon leads out from the ribbon supply core cylinder S1, passes through the first opening for ribbon 211 of the supply cylinder 21, enters into the winding cylinder 22 via the second opening for ribbon 221 of the winding cylinder 22, and is wound on the ribbon winding core cylinder S2. When the ribbon cartridge is installed in the printer, the ribbon led to the winding cylinder 22 from the supply cylinder 21 is pressed by the printing hear of the printer and is extended at the ribbon exposing opening 232*a*, and the transmission gear 25 is engaged with a driving member of the printer, so that when the transmission gear 25 is driven by the driving member and rotates, the transmission gear 25 in turn drives the support shaft 24 fixedly connected thereto to rotate, and the ribbon winding core cylinder S2 is rotated along with the support shaft 24 to pull and wind the ribbon wound on the ribbon supply core cylinder S1.

Further, the ribbon cartridge 2 includes a pull handle 26, which is disposed on the bracket 23 and is configured for handling by a user to install a ribbon cartridge in the thermal transfer printer or detach the ribbon cartridge from the thermal transfer printer. In the present embodiment, the pull handle 26 is connected with the second cantilever part 232 at a side of the second cantilever part 232 away from the winding cylinder 22.

Figure 5:
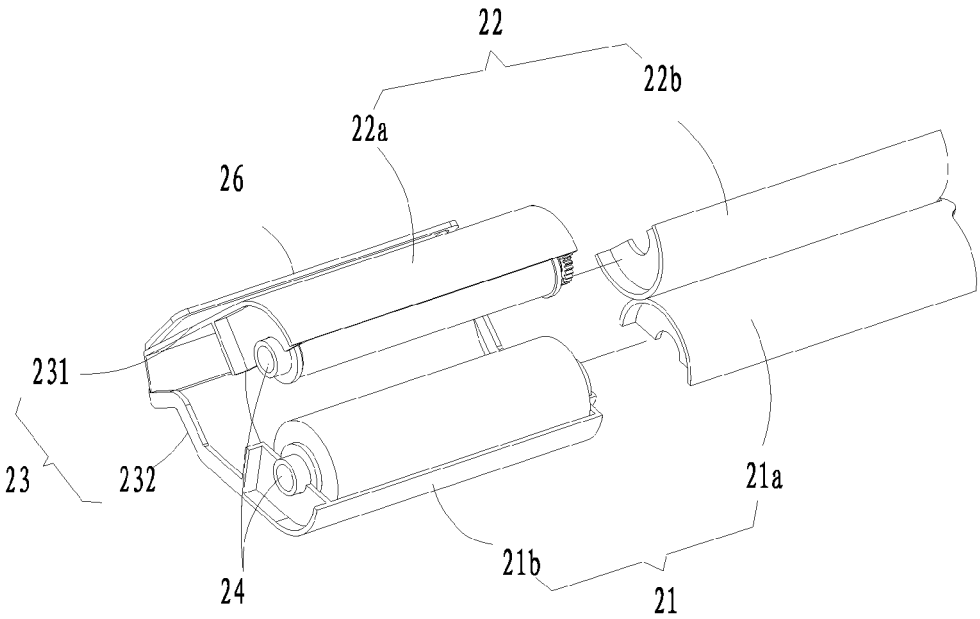
FIG. 5 is a first structural exploded view of the ribbon cartridge according to the embodiment of the present disclosure.
Figure 6:
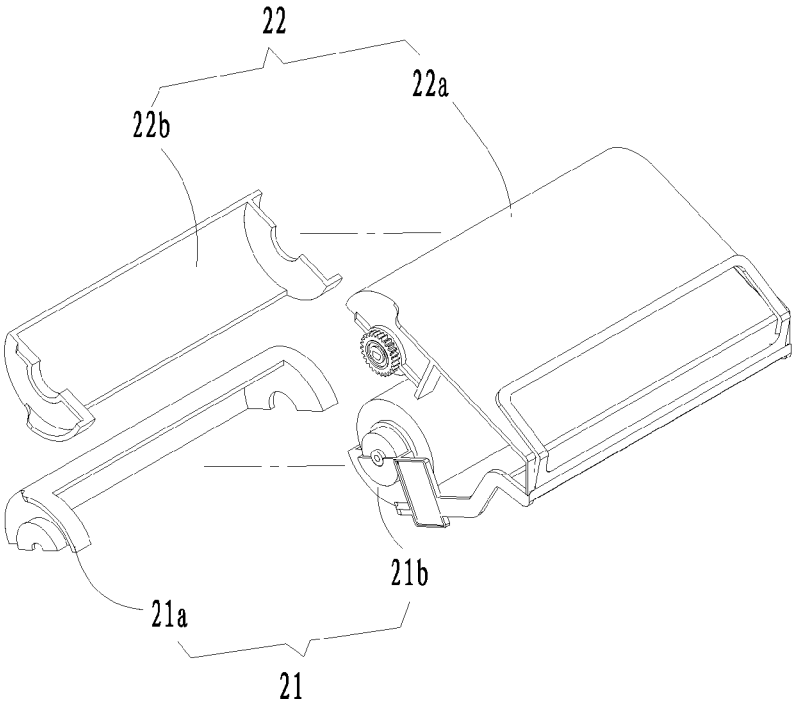
FIG. 6 is a second structural exploded view of the ribbon cartridge according to the embodiment of the present disclosure.

FIG. 5 is a first structural exploded view of the ribbon cartridge according to the embodiment of the present disclosure, and FIG. 6 is a second structure exploded view of the ribbon cartridge according to the embodiment of the present disclosure. As shown in FIG. 5 and FIG. 6, the supply cylinder 21 includes a first part 21*a* and a first half-cylinder body 21*b*, and the winding cylinder 22 includes a second part 22*a* and a second half-cylinder body 22*b*, where the first part 21*a* and the first half-cylinder body 21*b* of the supply cylinder 21 are fixedly or detachably connected with each other to form a space for accommodating the unused ribbon, and the second part 22*a* and the second half-cylinder body 22*b* of the winding cylinder 22 are fixedly or detachably connected with each other to form a space for accommodating the used ribbon.

In the present embodiment, the first part 21*a* and the first half-cylinder body 21*b* of the supply cylinder 21 are fixedly connected by plastic welding or adhesive, and likewise the second part 22*a* and the second half-cylinder body 22*b* of the winding cylinder 22 are fixedly connected by plastic welding or adhesive. The first half-cylinder body 21*b* of the supply cylinder 21 is fixedly connected or integrally formed with the first cantilever part 231 of the bracket 23, the second part 22*a* of the winding cylinder 22 is fixedly connected or integrally formed with the second cantilever part 232 of the bracket 23, those two support shafts 24 for the supply cylinder 21 are both disposed on the first half-cylinder body 21*b* of the supply cylinder 21, and those two support shafts 24 for the winding cylinder 22 are both disposed on the second part 22*a* of the winding cylinder 22. In assembling the ribbon cartridge 2, the ribbon supply core cylinder S1 wound by the unused ribbon is placed in the first half-cylinder body 21*b* of the supply cylinder 21, with both ends of the ribbon supply core cylinder S1 matching with those two support shafts 24 placed on the first half-cylinder body 21*b* of the supply cylinder 21 in a plugging manner, and each positioning groove on the ribbon supply core cylinder S1 matching with the rotation stop part 241 on the corresponding support shaft 24 in a plugging manner; meanwhile, the ribbon winding core cylinder S2 is placed in the second part 22*a* of the winding cylinder 22, with both ends of the ribbon winding core cylinder S2 matching with those two support shafts 24 placed on the second part 22*a* of the winding cylinder 22 in a plugging manner, and each positioning groove on the ribbon winding core cylinder S2 matching with the rotation stop part 241 on the corresponding support shaft 24 in a plugging manner; subsequently, the unused ribbon is led out from the ribbon supply core cylinder S1, and a leading end of the unused ribbon is fixed to the ribbon winding core cylinder S2 in the winding cylinder 22; and eventually, the first part 21*a* and the first half-cylinder body 21*b* of the supply cylinder 21 are plastic welded together, and the second part 22*a* and the second half-cylinder body 22*b* of the winding cylinder 22 are plastic welded together, thereby accomplishing the assembling of the ribbon cartridge 2.

In some other embodiments of the present disclosure, the first part 21*a* and the first half-cylinder body 21*b* of the supply cylinder 21 match with each other in a clamping manner by a clamping part and a clamping slot, and the second part 22*a* and the second half-cylinder body 22*b* of the winding cylinder 22 match with each other in a clamping manner by a clamping part and a clamping slot, so that the first part 21*a* of the supply cylinder 21 is detachable from the first half-cylinder body 21*b* of the supply cylinder 21, and the second part 22*a* of the winding cylinder 22 is detachable from the second half-cylinder body 22*b* of the winding cylinder 22. For example, a clamping part is provided on one of the first part 21*a* and the first half-cylinder body 21*b* of the supply cylinder 21, and a clamping slot is provided on the other of the first part 21*a* and the first half-cylinder body 21*b* of the supply cylinder 21, in this case, when the clamping part matches with the clamping slot in a clamping manner, the first part 21*a* of the supply cylinder 21 is fixed to the first half-cylinder body 21*b* of the supply cylinder 21, and when the clamping part is detached from the clamping slot, the first part 21*a* of the supply cylinder 21 is detached from the first half-cylinder body 21*b* of the supply cylinder 21.

When the first part 21*a* and the first half-cylinder body 21*b* of the supply cylinder 21 are fixedly connected and the second part 22*a* and the second half-cylinder body 22*b* of the winding cylinder 22 are fixedly connected, the ribbon cartridge 2 is entirely replaced after the ribbon in the ribbon cartridge 2 is used up, thus the ribbon can be quickly replaced. When the first part 21*a* and the first half-cylinder body 21*b* of the supply cylinder 21 are detachably connected and the second part 22*a* and the second half-cylinder body 22*b* of the winding cylinder 22 are detachably connected, after the ribbon in the ribbon cartridge 2 is used up, the first part 21*a* of the supply cylinder 21 is detached from the first half-cylinder body 21*b* of the supply cylinder 21, and the second part 22*a* of the winding cylinder 22 is detached from the second half-cylinder body 22*b* of the winding cylinder 22, so that the ribbon supply core cylinder S1 in the supply cylinder 21 and the ribbon winding core cylinder S2 wound by the used ribbon in the winding cylinder 22 are detached, and a new ribbon supply core cylinder S1 wound by the unused ribbon and a new ribbon winding core cylinder S2 are installed, thus the housing of the ribbon cartridge is reused, thereby reducing consumptive costs.

Preferably, the suspending end of the first cantilever part 231 is tangent to and integrally formed with the wall of the second part 22*a* of the winding cylinder 22, the suspending end of the second cantilever part 232 is tangent to and integrally formed with the wall of the supply cylinder 21, and the first cantilever part 231 is formed integrally with the second cantilever part 232. Preferably, the first cantilever part 231 is embodied as a bent plate, and a part of the second cantilever part 232 located at each of two sides of the ribbon exposing opening 232*a* is embodied as a bent rod.

As such, the supply cylinder and the winding cylinder of the ribbon cartridge provided in the present disclosure are connected via the bracket including a first cantilever part and a second cantilever part, where a first end of the first cantilever part is connected with a first end of the second cantilever part, a second end of the first cantilever part is connected with the winding cylinder, a second end of the second cantilever part is connected with the supply cylinder, the ribbon exposing opening is arranged in the second cantilever part, and the winding cylinder and the supply cylinder are arranged in parallel and close to each other. Therefore, the size of the ribbon cartridge of the present disclosure in a ribbon transmission direction is shortened by a diameter of the winding cylinder, and hence the ribbon cartridge of the present disclosure has a structure more compact than that of the existing ribbon cartridge.

Figure 7:
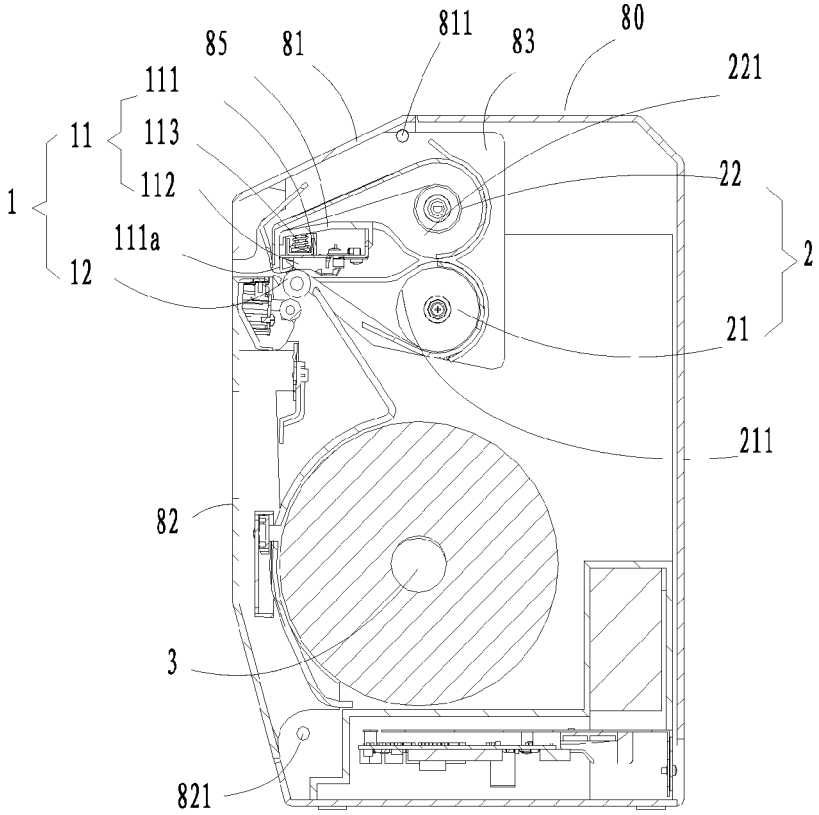
FIG. 7 is a section structural view of a thermal transfer printer adopting the ribbon cartridge according to the embodiment of the present disclosure.
Figure 8:
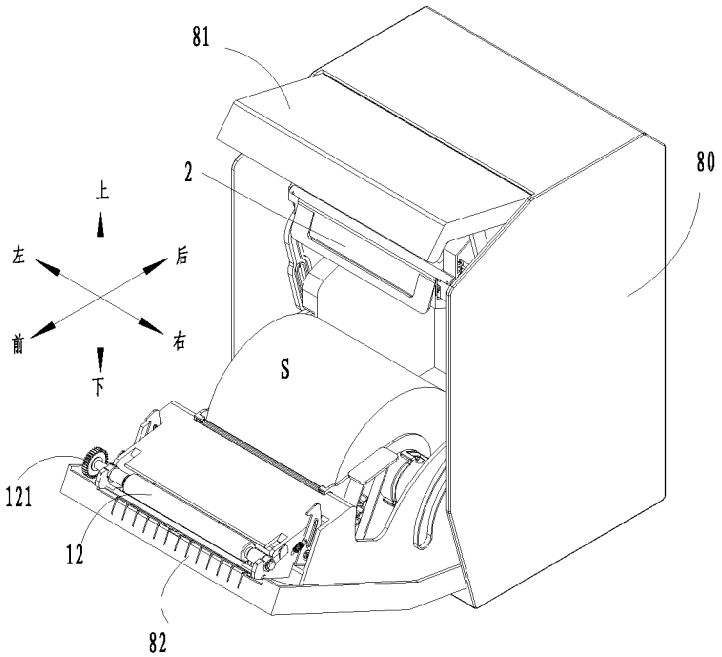
FIG. 8 is an isometric structural view of the thermal transfer printer adopting the ribbon cartridge according to the embodiment of the present disclosure, where an upper cover and a front cover of the thermal transfer printer are opened.
Figure 9:
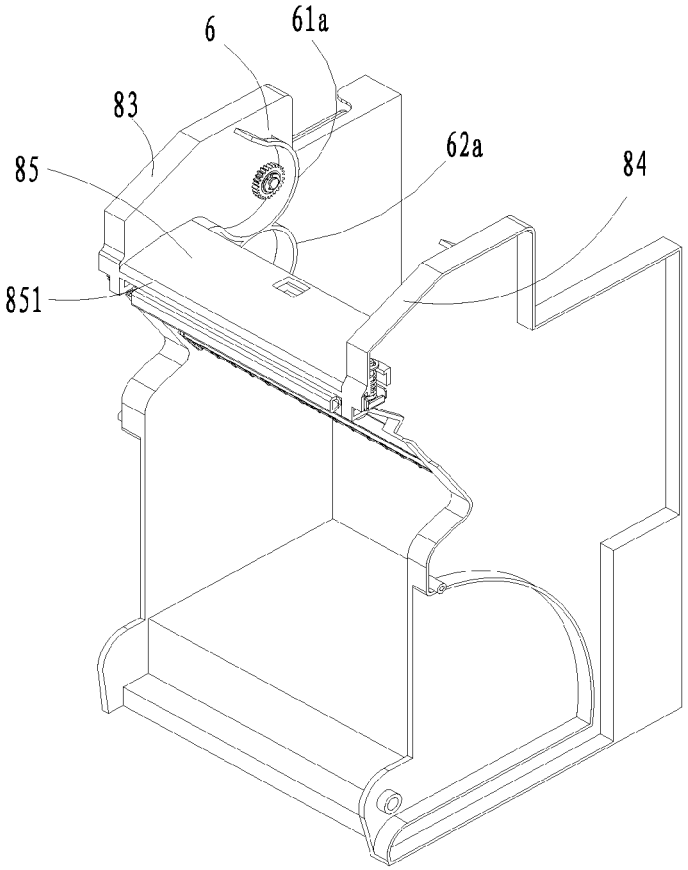
FIG. 9 is a partial structural view of the frame of the thermal transfer printer adopting the ribbon cartridge according to the embodiment of the present disclosure.

FIG. 7 is a section structural view of a thermal transfer printer adopting the ribbon cartridge according to the embodiment of the present disclosure, FIG. 8 is an isometric structural view of the thermal transfer printer adopting the ribbon cartridge according to the embodiment of the present disclosure, where an upper cover and a front cover of the thermal transfer printer are opened, and FIG. 9 is a partial structure view of the frame of the thermal transfer printer adopting the ribbon cartridge according to the embodiment of the present disclosure. As shown in FIG. 7, FIG. 8, and FIG. 9, the thermal transfer printer includes a frame, a printing mechanism 1, a ribbon cartridge 2, and a paper roll support mechanism 3. The frame includes a body 80, an upper cover 81, and a front cover 82. As indicated by directions shown in FIG. 8, the upper cover 81 is above the body 80, and the front cover 82 is in front of the body 80. The upper cover 81 is pivoted with the body 80 via a first pivot shaft 811, and the front cover 82 is pivoted with the body 80 via a second pivot shaft 821. Both the upper cover 81 and the front cover 82 may be rotatably open or close relative to the body 80.

The body 80 includes a left wall 83, a right wall 84 and a connection part 85. The left wall 83 and the right wall 84 are parallel to each other, and are distant from each other by a distance lager than or equal to the bigger one of widths of the printing paper and the ribbon. The connection part 85 is perpendicularly connected between the left wall 83 and the right wall 84, and preferably a front portion 851 of the connection part 85 has an arc-shaped cross section.

A printing mechanism 1, which is configured to print preset content on printing paper, includes a printing head assembly 11 and a platen 12. The platen 12 is disposed at an inner side of the front cover 82 and has an axis extending in a width direction of the printing paper, and one end of the platen 12 is provided with a platen gear 121. When the front cover 82 is closed, the platen gear 121 is transmission connected with the driving member (not shown) of the printer, and is driven by the driving member to rotate about its own axis. The printing head assembly 11 includes a support plate 111, a printing head 112, and at least one elastic element 113.

The support plate 111 is located below the connection part 85 and between the left wall 83 and the right wall 84, and is movably connected with the connection part 85. The printing head 112 is fixedly connected with the support plate 111, and is located at a side of the support plate 111 away from the connection part 85. The elastic element 113, which may be a pressure spring, a torsion spring or a plate spring, is located between the support plate 111 and the connection part 85, and has one end connected with the support plate 111 and the other end connected with the connection part 85. Under the effect of the elastic element 113, the support plate 111 causes the printing head 112 to always trend to move away from the connection part 85.

A positioning part (not shown) cooperating with the support plate 111 is additionally arranged on the body 80. Due to the restriction by the positioning part, the support plate 111 of the printing head assembly 11 can be stabilized at a preset distance from the connection part 85. When the front cover 82 is closed relative to the body 80, the platen 12 presses the printing head 112 and is tangent to the printing head 112, in this case, the printing head assembly 11 is supported by the platen 12. When the front cover 82 is opened relative to the body 80, the platen 12 is separated from the printing head 112, and the printing head assembly 11 is supported by the positioning part disposed on the body 80.

Preferably, a front end of the support plate 111 includes a bent portion 111*a*, which is at front of the printing head 112 but is lower than the printing head 112. The bent portion 111*a* is configured to guide the ribbon passing by the printing head 112 to enter into the winding cylinder 22, and protect the printing head 112 against being contacted by the ribbon cartridge 2 during installing of the ribbon cartridge 2, thereby elongating the service life of the printing head 112.

The paper roll support mechanism 3 is disposed on the front cover 82 or the body 80. In the printing paper transmission direction, the paper roll support mechanism 3 is at the upstream of the platen 12, and is configured to support a printing paper roll. The paper roll support mechanism 3 may be a paper roll support rack or a paper storage. In the present embodiment, the paper roll support mechanism 3 is a paper roll support rack disposed at an inner side of the front cover 82. To load printing paper, the front cover 82 is opened relative to the body 80, and the paper roll support mechanism 3 is rotated out from the body 80 along with the front cover 82, so that the paper roll can be replaced conveniently. After the replace of the paper roll, a leading end of the new printing paper is led out from the paper roll and passes by the platen 12, and then the front cover 82 is closed relative to the body 80, so that the printing paper is sandwiched between the printing head 112 and the platen 12.

The ribbon cartridge 2 has the structure already described as above, which will not be given again hereinafter.

Figure 10:
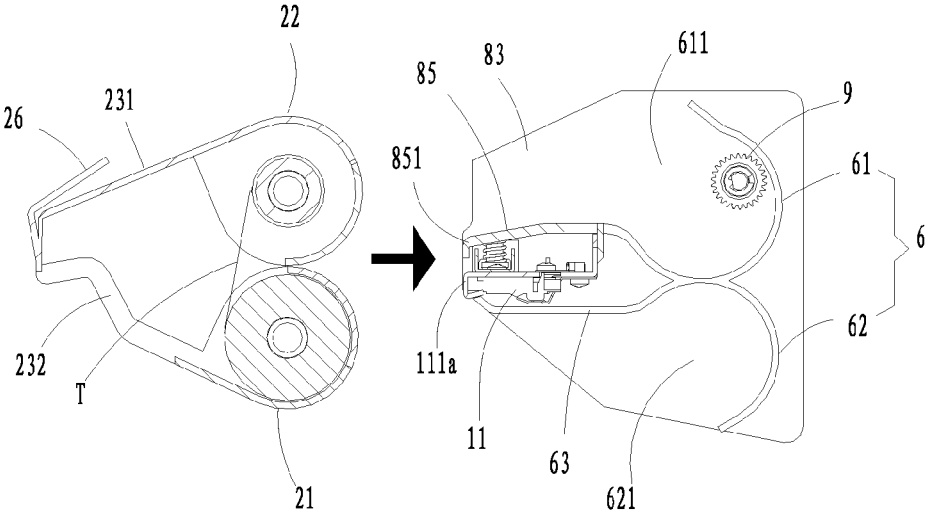
FIG. 10 is a first installing view of the ribbon cartridge according to the embodiment of the present disclosure onto the thermal transfer printer.
Figure 11:
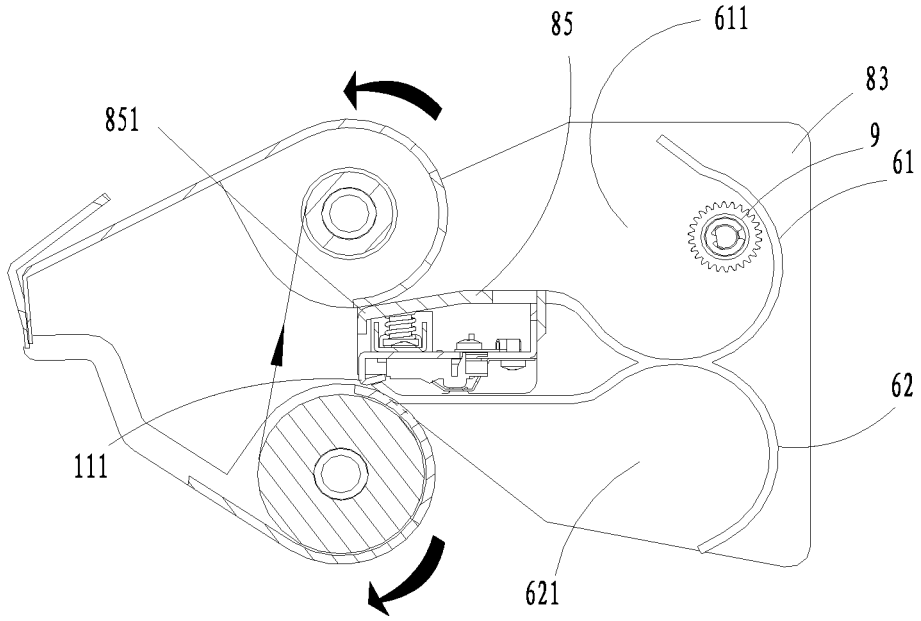
FIG. 11 is a second installing view of the ribbon cartridge according to the embodiment of the present disclosure onto the thermal transfer printer.

FIG. 10 is a first installing view of the ribbon cartridge according to the embodiment of the present disclosure onto the thermal transfer printer, and FIG. 11 is a second installing view of the ribbon cartridge according to the embodiment of the present disclosure onto the thermal transfer printer. As shown in FIG. 10 and FIG. 11, the ribbon cartridge 2 is detachably connected with the body 80. When installed in the body 80, the ribbon cartridge 2 is located between the left wall 83 and the right wall 84 of the body 80, and the supply cylinder 21 and the winding cylinder 22 of the ribbon cartridge 2 are parallel to each other at one side of the printing head 112. A positioning part 6 is disposed between the left wall 83 and the right wall 84 of the body 80, and is configured to position the supply cylinder 21 and the winding cylinder 22 of the ribbon cartridge 2.

The positioning part 6 includes a first positioning portion 61 for positioning the winding cylinder 22 and a second positioning portion 62 for positioning the supply cylinder 21, both of which extend perpendicularly with a surface of the left wall 83. Preferably, each of the first positioning portion 61 and the second positioning portion 62 has a split structure, where the first positioning portion 61 includes two first arc-shaped ribs 61*a* (as shown in FIG. 9) symmetrically arranged on the left wall 83 and the right wall 84 of the body 80, respectively, and the second positioning portion 62 includes two second arc-shaped ribs 62*a* (as shown in FIG. 9) symmetrically arranged on the left wall 83 and the right wall 84 of the body 80, respectively.

The body 80 is further provided with a guide structure configured to guide the winding cylinder and the supply cylinder of the ribbon cartridge during installing of the ribbon cartridge. The guide structure includes an upper guide portion and a lower guide portion which are located at upper and lower sides of the printing head assembly 11, respectively, where one of the upper guide portion and the lower guide portion is embodied by guide ribs arranged on the left wall 83 and the right wall 84, and the other of the upper guide portion and the lower guide portion is embodied by the connection part 85. In the present embodiment, the lower guide portion is embodied by guide ribs 63 extending below the printing head assembly 11 and the upper guide portion is embodied by the connection part 85 extending above the printing head assembly 11. The first arc-shaped ribs 61*a* is transitively connected with the connection part 85, and likewise the second arc-shaped ribs 62*a* is transitively connected with the guide rib 63. As such, during installing the ribbon cartridge 2, the wall of the winding cylinder 22 slidably contacts the connection part 85 used for guiding and is eventually maintained in the first positioning portion 61, and the wall of the supply cylinder 21 slidably contacts the guide rib 63 used for guiding and is eventually maintained in the second positioning portion 62.

In some other embodiments of the present disclosure, each of the first positioning portion 61 and the second positioning portion 62 is of an integral structure, and has one end connected to the left wall 83 of the body 80 and the other end connected to the right wall 84 of the body 80. The first positioning portion 61 is at the rear side of the printing head assembly 11, the second positioning portion 62 is arranged in parallel with the first positioning portion 61, external walls of the first positioning portion 61 and the second positioning portion 62 abut against each other, and shapes of cross sections of the first positioning portion 61 and the second positioning portion 62 fit the shapes of the cross sections of the winding cylinder 22 and the supply cylinder 21 of the ribbon cartridge 2. Here, the first positioning portion 61 has an internal diameter fitting an external diameter of the winding cylinder 22 of the ribbon cartridge 2, and is configured to accommodate the winding cylinder 22 of the ribbon cartridge 2. An opening 611, which has a tapered shape, is formed at a side of the first positioning portion 61 toward the printing head assembly 11, a lower rim of the opening 611 is transitively connected with the connection part 85, and the minimum size of the opening 611 is larger than the external diameter of the winding cylinder 22. The second positioning portion 62 has an internal diameter fitting an external diameter of the supply cylinder 21 of the ribbon cartridge 2, and is configured to accommodate the supply cylinder 21 of the ribbon cartridge 2. An opening 621 is formed at a side of the second positioning portion 62 toward the printing head assembly 11, and an upper rim of the opening 621 extends below the printing head assembly 11. Preferably, the upper rim of the opening 621 of the second positioning portion 62 is connected with the bent portion 111*a* of the support plate 111 of the printing head assembly 11, and the minimum size of the opening 621 of the second positioning portion 62 is larger than the external diameter of the supply cylinder 21.

The installing of the ribbon cartridge of the present disclosure into the thermal transfer printer and detaching of the ribbon cartridge from the thermal transfer printer is described below.

To install the ribbon cartridge 2, a user may handle the ribbon cartridge 2 in such a way that the winding cylinder 22 of the ribbon cartridge 2 is above the supply cylinder 21 while the ribbon between the supply cylinder 21 and the winding cylinder 22 of the ribbon cartridge 2 faces the printing head assembly 11 and the connection part 85 of the frame; then the ribbon cartridge 2 is pushed in an arrow direction shown in FIG. 10 so that the winding cylinder 22 of the ribbon cartridge 2 is in contact with the front portion 851 of the connection part 85 in the body 80 while the supply cylinder 21 of the ribbon cartridge 2 is in contact with the bent portion 111*a* of the support plate 111 of the printing head assembly 11; subsequently, the ribbon cartridge 2 is further pushed by the user so that the supply cylinder 21 and the winding cylinder 22 of the ribbon cartridge 2 move apart from each other after overcoming the elastic force applied by the bracket 23. As shown in FIG. 11, after moving along the upper surface of the connection part 85, the winding cylinder 22 is in contact with the lower rim of the opening 611 of the first positioning portion 61, meanwhile, after passing by the bent portion 111*a* of the support plate 111 of the printing head assembly 11, the supply cylinder 21 is in contact with the upper rim of the opening 621 of the second positioning portion 62, thus the ribbon is in contact with the bent portion 111*a*, thereby driving the support shaft 24 on the supply cylinder 21 to release the ribbon. The ribbon cartridge 2 is further pushed subsequently, so that the supply cylinder 21 and the winding cylinder 22 of the ribbon cartridge 2 are moved across the printing head assembly 11 and the connection part 85 of the body 80, respectively, and at this point, the supply cylinder 21 and the winding cylinder 22 of the ribbon cartridge 2 move toward each other under the effect of the elastic force applied by the bracket 23 of the ribbon cartridge 2, so that the supply cylinder 21 of the ribbon cartridge 2 fits with the second positioning portion 62 in the body 80, and the winding cylinder 22 of the ribbon cartridge 2 fits with the first positioning portion 61 in the body 80. As such, under the effect of the elastic force applied by the bracket 23, the supply cylinder 21 and the winding cylinder 22 of the ribbon cartridge 2 sandwich both the printing head assembly 11 and the connection part 85 in the body 80, and are placed at positions constant relative to the printing head assembly 11, meanwhile, the transmission gear 25 in the ribbon cartridge 2 is transmission connected with a driving member 9 of the printer. In this case, the ribbon leading out from the supply cylinder, which is to be entered into the winding cylinder, extends at the ribbon exposing opening due to the pressure by the printing head assembly, and is easily in contact with the printing paper.

Therefore, by pushing the ribbon cartridge 2 toward the printing head assembly 11 from the outside of the printing head assembly 11, the supply cylinder 21 and the winding cylinder 22 of the ribbon cartridge 2 run across the printing head assembly 11 and are installed properly.

To detach the ribbon cartridge 2, the user pulls the pull handle in a direction away from the printing head assembly 11. Under the effect of the pulling force by the user, the winding cylinder 22 and the supply cylinder 21 move away from each other while overcoming the elastic force applied by the bracket 23, that is, the first cantilever part 231 and the second cantilever part 232 of the bracket 23 move away from each other, thus, the winding cylinder 22 of the ribbon cartridge 2 is moved out from the first positioning portion 61 via the opening 611 of the first positioning portion 61, and the supply cylinder 21 of the ribbon cartridge 2 is moved out from the second positioning portion 62 via the opening 621 of the second positioning portion 62, thereby extracting the ribbon cartridge 2.

By adopting the ribbon cartridge of the present disclosure in the thermal transfer printer provided in the embodiments, the supply cylinder and the winding cylinder of the ribbon cartridge installed in the frame of the printer are positioned at the same side of the printing head, and are arranged in parallel close to each other, therefore, the distance between front and rear sides of the printer is shortened by the diameter of one winding cylinder, so that the use of the printer on a desk with a limited top surface is facilitated.

Some preferred embodiments of the present disclosure have been described as above, but the scope of the present disclosure is not limited thereto, and various modifications and alternations may be made to the present disclosure by those of ordinary skills in the art. Any modifications, equivalent replacements and improvements made without departing from the spirit and principles of the present disclosure fall within the scope of the present disclosure.

The invention claimed is:

1. A thermal transfer printer, comprising: a frame; and a printing head assembly (11), a platen (12) and a paper roll support mechanism (3) which are disposed on the frame, wherein the thermal transfer printer further comprises a ribbon cartridge (2) installed in the frame and comprising: a bracket (23); a supply cylinder (21) disposed on the bracket (23) and configured for accommodating an unused ribbon; and a winding cylinder (22) disposed on the bracket (23) and configured for accommodating a used ribbon, wherein the supply cylinder (21) and the winding cylinder (22) are arranged in parallel, and wherein, the supply cylinder (21) and the winding cylinder (22) have an initial state in which the supply cylinder (21) and the winding cylinder (22) are close to each other and an open state in which the supply cylinder (21) and the winding cylinder (22) are away from each other due to an effect of an external force; and the winding cylinder (22) and the supply cylinder (21) of the ribbon cartridge (2) are moved away from each other to avoid the printing head assembly (11) during installing of the ribbon cartridge (2), and the winding cylinder (22) and the supply cylinder (21) of the ribbon cartridge (2) installed in place are close to each other at a same side of the printing head assembly (11);

the thermal transfer printer further comprises a first positioning portion (61) configured for positioning the winding cylinder (22) and a second positioning portion (62) configured for positioning the supply cylinder (21), and a driving member is disposed on the first positioning portion (61) and configured to drive a support shaft (24) on the winding cylinder (22) to rotate and wind a ribbon.

2. The thermal transfer printer of claim 1, wherein the bracket (23) is located at the same side of the supply cylinder (21) and the winding cylinder (22), and a ribbon exposing opening (232*a*) is provided in the bracket (23).

3. The thermal transfer printer of claim 1, wherein the bracket (23) is configured to apply an elastic force to the supply cylinder (21) and the winding cylinder (22), so that the supply cylinder (21) and the winding cylinder (22) always tend to return to the initial state.

4. The thermal transfer printer of claim 3, wherein the bracket (23) comprises a first cantilever part (231) and a second cantilever part (232) which is fixedly connected or integrally formed with the first cantilever part (231), a suspending end of the first cantilever part (231) is connected with the winding cylinder (22), a suspending end of the second cantilever part (232) is connected with the supply cylinder (21), and at least one of the first cantilever part (231) and the second cantilever part (232) is elastic.

5. The thermal transfer printer of claim 3, wherein the bracket (23) comprises a first cantilever part (231), a second cantilever part (232) which is pivoted with the first cantilever part (231), and an elastic element disposed between the first cantilever part (231) and the second cantilever part (232), wherein a suspending end of the first cantilever part (231) is connected with the winding cylinder (22), and a suspending end of the second cantilever part (232) is connected with the supply cylinder (21).

6. The thermal transfer printer of claim 1, wherein each of the supply cylinder (21) and the winding cylinder (22) comprises a cylinder body for accommodating a ribbon, an opening for ribbon (211, 221) formed on the cylinder body, and a support shaft (24) disposed on an end wall of the cylinder body along an axial direction of the cylinder body and configured for supporting a ribbon core cylinder, wherein a transmission gear (25) in a transmission connection with an external power is arranged on at least one of the support shaft (24) provided on the supply cylinder (21) and the support shaft (24) provided on the winding cylinder (22).

7. The thermal transfer printer of claim 1, wherein a cylinder body of the supply cylinder (21) comprises a first part (21*a*) formed integrally with the bracket (23) and a first half-cylinder body (21*b*) jointed with the first part (21*a*), a space for accommodating an unused ribbon is formed between the first part (21*a*) and the first half-cylinder body (21*b*), a cylinder body of the winding cylinder (22) comprises a second part (22*a*) formed integrally with the bracket (23) and a second half-cylinder body (22*b*) jointed with the second part (22*a*), and a space for accommodating a used ribbon is formed between the second part (22*a*) and the second half-cylinder body (22*b*).

8. The thermal transfer printer of claim 1, wherein a pull handle (26) is disposed on the bracket (23).

9. The thermal transfer printer of claim 1, wherein the frame comprises a body (80) and a guide structure disposed on the body (80) and configured to guide the winding cylinder and the supply cylinder of the ribbon cartridge during installing of the ribbon cartridge, the body (80) comprises side walls (83; 84) and a connection part (85) perpendicularly connected with the side walls (83; 84), and the printing head assembly (11) is configured to be installed on the connection part (85), wherein the guide structure comprises an upper guide portion and a lower guide portion which are located at upper and lower sides of the printing head assembly (11), one of the upper guide portion and the lower guide portion is formed by guide ribs arranged on the side walls (83; 84), and the other of the upper guide portion and the lower guide portion is formed by the connection part (85).

10. The thermal transfer printer of claim 9, wherein the first positioning portion (61) is formed by a first arc-shaped rib (61*a*) transitively connected with the connection part (85), the second positioning portion (62) is formed by a second arc-shaped rib (62*a*) transitively connected with the guide rib (63), and each of the first arc-shaped rib (61*a*) and the second arc-shaped rib (62*a*) protrudes from an inner surface of the side wall (83) and has an unenclosed structure with an opening.

11. A method for installing the thermal transfer printer of claim 1, comprising:

Pushing the ribbon cartridge (2) toward the printing head assembly (11) from an outer side of the printing head assembly (11), so that the supply cylinder (21) and the winding cylinder (22) of the ribbon cartridge (2) run across the printing head assembly (11) and installed in place.

* * * * *